US005333431A

United States Patent [19]

Houpt

[11] Patent Number: 5,333,431

[45] Date of Patent: Aug. 2, 1994

[54] ROOF COVERING ELEMENT COMPRISING PLASTIC STALKS

[76] Inventor: Friedhelm Houpt, Nördeltstr. 18, D-5778 Meschede, Fed. Rep. of Germany

[21] Appl. No.: 908,324

[22] Filed: Jul. 6, 1992

[51] Int. Cl.[5] ..... E04D 9/00

[52] U.S. Cl. ..... 52/314; 52/518; 52/555; 428/17; 428/141

[58] Field of Search ..... 52/518, 554, 555, 557, 52/750, 311.1, 314; 428/17, 141, 110

[56] References Cited

U.S. PATENT DOCUMENTS

| | | | |
|---|---|---|---|
| 614,478 | 11/1898 | Johnston | 52/750 |
| 1,492,610 | 5/1924 | Simpson | 52/518 |
| 1,961,139 | 6/1934 | Elder | 428/17 |
| 4,140,825 | 2/1979 | Korschorrek | 428/92 |
| 4,611,451 | 9/1986 | Symbold | 52/555 |
| 4,690,874 | 9/1987 | Saver et al. | 428/17 X |

FOREIGN PATENT DOCUMENTS

| | | |
|---|---|---|
| 0202518 | 11/1986 | European Pat. Off. . |
| 2053642 | 7/1972 | Fed. Rep. of Germany . |
| 3208460 | 9/1983 | Fed. Rep. of Germany . |
| 3311366 | 6/1984 | Fed. Rep. of Germany . |
| 2039822 | 8/1980 | United Kingdom . |

*Primary Examiner*—Carl D. Friedman
*Assistant Examiner*—Robert J. Canfield
*Attorney, Agent, or Firm*—Felfe & Lynch

[57] ABSTRACT

A flatly shaped roof covering element (1) comprising a plurality of plastic stalks (2) being arranged approximately parallel adjacent to each other and one above the other, their upper end regions (21) being joined together by heat bonding, the stalks (2) having irregular lengths and being irregularly shaped at their free ends (22), and having a helical cross-section, wherein the roof covering element (1) comprises a layer of paper (3, 3') on both sides of the bonded upper region (21) of the stalks (2), the paper being bonded thereto, wherein the bonded upper region is not flat.

5 Claims, 2 Drawing Sheets

ROOF COVERING ELEMENT COMPRISING PLASTIC STALKS

BACKGROUND OF INVENTION

1. Field of Invention

The invention relates to roof covering elements and methods for their manufacturing and more particularly to roof covering elements comprising a plurality of plastic stalks being arranged approximately parallel adjacent to each other, their upper ends being joined together by heat bonding, the stalks having irregular lengths and being shaped irregularly at their free ends and having a helical cross-section. Such roof covering elements are used for building roofs to resemble natural thatched roofs.

2. Description of the Prior Art

A roof covering element is known from the German Patent Specification 20 53 642, which comprises a plurality of plastic stalks, arranged approximately side by side and above each other in parallel, being flattened and heat bonded with each other in their upper regions and also heat bonded to an underlying base. It is a disadvantage that the base is a solid plastic sheet which makes the roof covering element stilt, heavy and expensive.

A plastic stalk is known from the German Patent Specification 33 11 366, which is to be used in the same manner as natural stalks, i.e. a plurality of plastic stalks is tied up in bundles and fastened to a conventional roof structure.

This method requires high labour costs, and the roof is sensitive against wind pressure resulting in fractures of the stalks and damages to the roof.

A building element for covering outside walls and roofs for thermal and water protection is known from the German Patent Specification 32 08 460, which comprises stalks and the like material woven into or otherwise fastened onto a carrier fabric, shaped like a grid. This element disadvantageously is sensitive and subject to reduced durability.

Another roof covering element is known from the British Patent Specification 2 039 822, comprising a plurality of plastic stalks being bonded in a carrier base of synthetic resin at their upper regions. The stalks have different lengths. This roof covering element requires a high amount of material and labour costs when producing it and has a high weight per area, which disadvantageously restricts its range of application.

Finally a roof covering element is known from the European Patent Specification 0 202 518 which consists of a plurality of plastic stalks which are arranged approximately parallel adjacent to each other and one above the other, which are flattened in their upper end region and are joined together by heat bonding, the roof covering element having an underlying base which consists of a grid-shaped woven material and is joined to the stalks, likewise by heat bonding, wherein the stalks consist of hard PVC or shock-resistant hard PVC, the stalks are of irregular lengths and are irregularly shaped at their free ends, the stalks have a helical cross-section and the stalks have on their outsides at least one longitudinally extending, projecting web or fluke.

Although the roof covering element described last has advantages in general, it has also be found, that there still is room for improvement regarding the fastening of the ends of the stalks to the grid shaped material, which method requires some effort, and the forming of the stalks having longitudinal webs which finally results in plastic stalks having somewhat different shape than natural stalks.

It is therefore an object of the present invention to provide a roof covering element comprising a plurality of plastic stalks being arranged approximately parallel adjacent to each other and one above the other, being joined together by heat bonding, the stalks having a irregular length and being irregularly shaped at their free ends and having a helical cross-section which roof covering element is light in weight, easy to manufacture and durable in use.

It is also an object of the present invention to provide a plastic stalk for that roof covering element, which is easy to manufacture, durable and resembles a natural stalk.

It is a further object of the present invention to provide a method for producing the plastic stalk according to the invention in a reliable and efficient process.

It is a still further object of the present invention to provide a method for producing the roof covering element according to the invention in a simple and inexpensive process using conventional equipment.

Other objects, advantages, and applications of the present invention will become apparent to those skilled in the art when the accompanying description of a preferred embodiment is read in conjunction with the accompanying drawing.

SUMMARY OF THE INVENTION

According to the invention, these objects are achieved by the aspects thereof, which will be described subsequently in greater detail.

A first aspect of the invention comprises a generally flat-shaped roof covering element with a plurality of plastic stalks being arranged approximately parallel adjacent to each other and one above the other, their upper end regions being joined together by heat bonding, the stalks having a irregular length and being irregularly shaped at their free ends, and having a helical cross-section, wherein the roof covering element comprises a layer of paper on both sides of the bonded upper region of the stalks, the paper being bonded thereto.

The advantage of the roof covering element according to the present invention is that the upper end regions of the plastic stalks need not be flattened anymore and are joined together by heat bonding, resulting in a rigid upper region of the roof covering element, which is laminated with a paper strip on both sides, making it easy to handle and to mount.

The paper strips have the additional advantage, that during the manufacturing process of the roof covering element, which will be described later in more detail, the upper regions of the plastic stalks will not adhere to the heating plates, because the paper strips are positioned between the plastic stalks and the heating plates.

In a preferred embodiment of the invention the plastic material for the stalks is hard polyvenylchloride (PVC), which preferably is shock-resistant to make the stalk more durable.

In order to make the roof covering element look like natural stalks, the plastic stalks have different color tones ranging from dark yellow to light brown in the way of an authentic thatched roof.

The coloring of the stalks is provided by dying several batches of plastic stalks in different shades, which is a known process in the art.

In a preferred embodiment the roof covering element has at least one pre-drilled hole in the upper region thereof for easier fastening in roof structure i.e. by nails.

Another aspect of the invention is providing a plastic stalk for the usage in a roof covering element according to the invention wherein the cross-section of the stalk generally has the shape of the numeral six with a first curved line extending from the uppermost point down to the downmost point, a straight line extending from the downmost point towards the uppermost point up to a point spaced apart from the uppermost point, and a second curved line extending from the uppermost point of the straight line towards the first curved line, the connecting points between the straight line and the first and second curved lines being angular.

The plastic stalk has the advantage of both being durable, non burnable and easy to produce, the production method being a still further aspect of the invention, which is subject of a more detailed explanation in the following.

This aspect of the present invention, comprises a method for manufacturing the plastic stalk according to the invention with the steps of

- forward extruding an elongated body having the cross-section of two plastic stalks connected at their uppermost points such, that their downmost points face away from each other,
- calibrating the elongated body,
- cooling the elongated body,
- separating the elongated body longitudinally to produce the cross-section of the plastic stalks according to the invention,
- cutting the plastic stalks to length and
- punching the irregular shape of the free and of the plastic stalk.

This method involves such devices as a forward extruder, to which the plastic material is supplied in form of powder or granulates, the extruder comprising a die to form an elongated plastic body having a cross-section like described before, whereupon this string of plastic material still being heated from the extrusion passes through a calibrating device to give it its accurate shape, subsequently the material will pass through a cooling chamber filled with water, whereupon the water will be drained and further removed by means of an extraction fan, whereupon the stalks will be cut to length and have their irregular ends punched on which devices are known in the trade.

Finally it is an aspect of the invention to provide a method for manufacturing a roof covering element according to the invention comprising the steps of

- supplying the plastic stalks side by side onto a belt conveyor,
- preheating the plastic stalks,
- positioning endless paper strips from rolls onto and under the one end region of the plastic stalks,
- heat bonding the one end region of the plastic stalks together and simultaneously bonding the paper strips onto the outside of those regions,
- cooling,
- drilling holes into the bonded upper region,
- cutting straight the upper edge of the bonded region and
- cutting out the single roof covering elements by cutting through the upper bonded region in parallel with the plastic stalks.

The latter method involves such devices as a first belt conveyor, having spaced apart fins extending from the belt transversely to the running direction thereof and accommodating plastic stalks therein, which stalks subsequently are supplied onto a second belt conveyor with a flat belt surface, which will transport the stalks side by side through a preheating zone, whereupon endless paper strips provided from rolls adjacent to the second belt conveyor are positioned underneath and above the one end region of the plastic stalks, the paper strips travelling on the belt conveyor with the one region of the stalks inbetween them, the other region of the stalks remaining uncovered, whereupon the region covered with the paper strips will pass through two heating plates, which will bond this region of the stalks together while the paper strips will prevent sticking to the heating plates, subsequently the bonded region will be cooled by passing it through two cooling plates, whereupon the now solid bonded region is predrilled and the upper edge thereof is cut straight with a first rotating saw, the other end remaining as it is, resulting in different lengths of the stalks, and finally the up to now endless strip of roof covering elements is separated along a line parallel to the stalks by a second rotating saw blade.

BRIEF DESCRIPTION OF THE DRAWING

The description herein makes reference to the accompanying drawing wherein like reference numerals refer to like parts, and in which.

DESCRIPTION OF A PREFERRED EMBODIMENT

Figure 1:
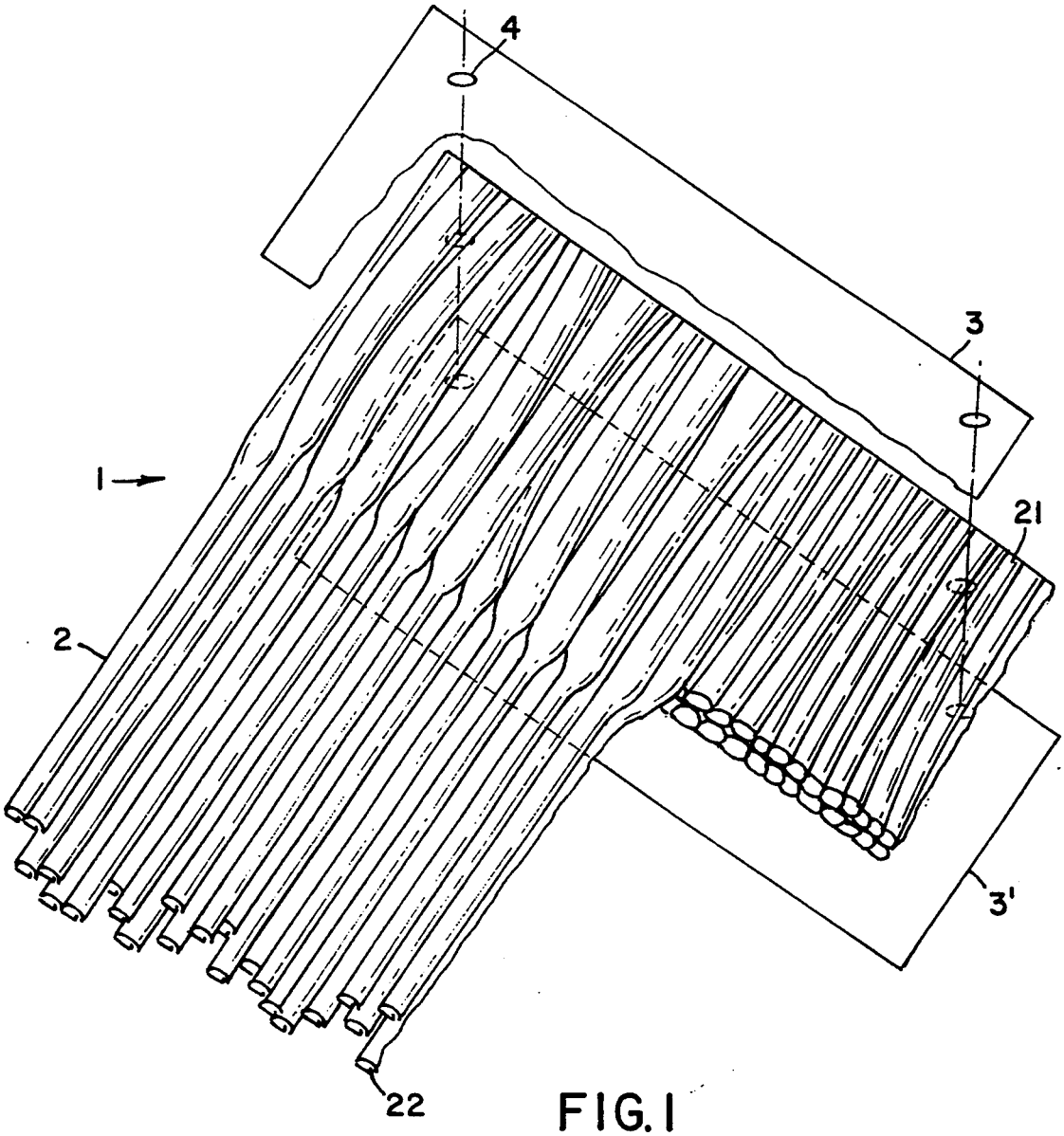
FIG. 1 is a perspective view of a preferred embodiment of a roof covering element according to the invention, in which the plastic stalks at the right side have been removed for more clarity and in which the upper paper cover has been partly broken away and both paper covers are shown in an exploded view.

Referring now to FIG. 1 a roof covering element 1 comprises a plurality of plastic stalks 2, which are arranged side by side and above each other and are bonded together in an upper region 21, in which the form of the cross-section of the stalks is compressed to an almost solid body with some small cavities.

The stalks 2 have different lengths and their free ends 22 are irregularly shaped like the ends of natural stalks.

The region 21 is covered with a paper layer 3 on the one side and a paper layer 3' on the other side, the paper layers 3, 3' being of equal size and of rectangular shape and flush with the upper edge of the region 21.

The paper layers 3, 3' are securely fastened by bonding onto the faces of the region 21.

The region 21 comprises two holes 4 adjacent to the upper edge thereof, the holes 4 passing through the region 21 and the attached paper layers 3, 3'.

Figure 2:
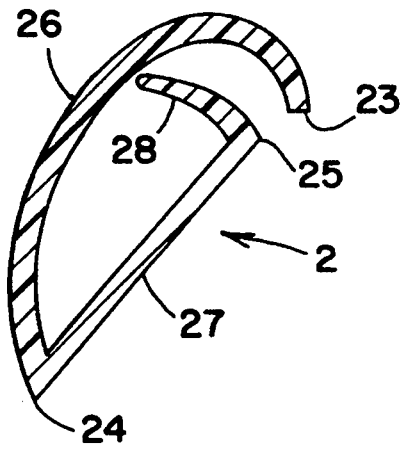
FIG. 2 is a cross-section of a plastic stalk according to the invention in a larger scale and FIG. 3 is a cross-section of a semi-finished plastic stalk, which will be separated along the line A—A in a later process step.

Referring now to FIG. 2 the cross-section of the plastic stalk 2 is shown in enlargement comprising an uppermost point 23 and a downmost point 24, between the points 23 and 24 there extends a curved portion 26 being bent in a convex manner like the left half of the numeral six.

Extending from the downmost point 24 there is a straight portion 27 being directed towards the uppermost point 23, but ending short of it in a point 25, from whereon a bent portion 28 extends towards the portion 26 and ending adjacent thereto. The connecting points 24 and 25 are shaped in angles.

Figure 3:
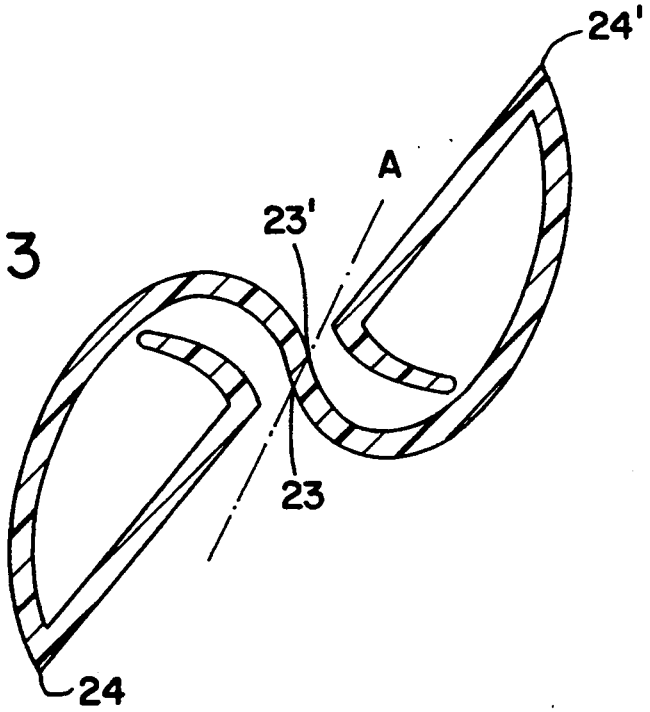

Referring finally to FIG. 3 there is shown the cross-section of a semi-finished product consisting of two plastic stalks being connected at their uppermost points 23, 23′ in such a manner, that their downmost points 24, 24′ face away from each other.

The cross-section shown in FIG. 3 will in a subsequent process step be separated along the dashed line A—A resulting in two cross-sections as shown in FIG 2.

I claim:

1. A flatly shaped roof covering element comprising a plurality of plastic stalks being arranged approximately parallel adjacent to each other and one above the other, their upper end regions being joined together by heat bonding, the stalks having irregular lengths and being irregularly shaped at their free ends, and the stalks having a helical cross-section, characterized in that, the roof covering element comprises a layer of paper on both sides of the bonded upper region of the stalks, the paper being bonded thereto, wherein the bonded upper region is not flat.

2. A roof covering element as claimed in claim 1, wherein the stalks consist of hard PVC or shock-resistent hard PVC.

3. A roof covering element as claimed in claim 2, wherein the stalks have different color tones in the manner of natural reed-thatches.

4. A roof covering element as claimed in claim 1, wherein the bonded upper region has at least one hole therein.

5. A plastic stalk for the usage in a roof covering element as claimed in claim 1, characterized in that, the cross-section thereof generally has the shape of the numeral six with a first curved line extending from the uppermost point down to the downmost point, a straight line extending from the downmost point towards the uppermost point up to a point spaced apart from the uppermost point, and a second curved line extending from the upper point of the straight line towards the first curved line, the connecting points between the straight line and the first and second curved lines being angular.

* * * * *